US006044763A

United States Patent [19]

Colaluca

[11] Patent Number: 6,044,763

[45] Date of Patent: Apr. 4, 2000

[54] DEVICE AND PROCEDURE FOR THE MARKING OF STACKED SHEET STOCK

[75] Inventor: Antoine Colaluca, Jonage, France

[73] Assignee: Technifor, Miribel, France

[21] Appl. No.: 09/185,726

[22] Filed: Nov. 4, 1998

[30] Foreign Application Priority Data

Nov. 4, 1997 [FR] France ..... 97 14117

[51] Int. Cl.[7] ..... B41F 1/28

[52] U.S. Cl. ..... 101/476; 101/4; 101/35; 101/232; 400/521

[58] Field of Search ..... 101/4, 11, 35, 101/476, 232, 37, 40.1, 30, 36, 40, 43, 44; 400/521, 525, 535, 538, 542

[56] References Cited

U.S. PATENT DOCUMENTS

| | | | |
|---|---|---|---|
| 690,696 | 1/1902 | Cheshire | 101/476 |
| 3,834,691 | 9/1974 | Paulson | 271/100 |
| 4,441,831 | 4/1984 | Tipple et al. | 400/134.3 |
| 4,536,770 | 8/1985 | Allen et al. | 346/29 |
| 4,909,149 | 3/1990 | Melcher | 101/232 |
| 5,785,436 | 7/1998 | Harrison et al. | 400/124.01 |

*Primary Examiner*—John S. Hilten
*Assistant Examiner*—Dave A. Ghati
*Attorney, Agent, or Firm*—Dowell & Dowell, P.C.

[57] ABSTRACT

A device including a receiving device for a stack formed by sheets of stock material that move by gravity along the receiving device toward a marker and which includes positioning elements for positioning a sheet to be marked with respect to the marker, and which also includes an ejector for the marked sheets. The marker is arranged under the receiving device and it is used to mark the underside of each bottom sheet of the stack.

11 Claims, 5 Drawing Sheets

DEVICE AND PROCEDURE FOR THE MARKING OF STACKED SHEET STOCK

BACKGROUND OF THE INVENTION

1. Field of the Invention

The present invention relates to marking devices for sheets of stock materials such as plates, tags and the like.

2. History of the Related Art

The customary type of such a device is provided with a vertical feed box in which are stacked the sheets. The inside walls of the box encircle the entire periphery of the sheets for their lateral support.

A conveyance unit moves the bottom sheet of the stack towards a marking head. After having been marked, the sheet in question is ejected from the marking area by the next sheet extracted from the lower portion of the stack.

All the marked sheets can be piled up on a receiver-chute or ejected in bulk.

Such a device presents, however, disadvantages in the sense that it is constituted by a great number of mechanical elements. Most of these elements are not adapted for sheet stock of different sizes so that it becomes necessary to change the majority of these elements with every change of size of the sheets to be marked.

Further, it is essential to control an exact guiding of the sheet stock along the conveyor elements in order to ensure a satisfactory positioning. Lastly, each sheet must be immobilized by clamping at the marking area in order to ensure a satisfactory quality of marking. This is achieved by relatively complicated clamping elements which increases the cost of the marking device.

SUMMARY OF THE INVENTION

To remedy all the disadvantages of the afore-mentioned type, the present invention has the object to produce a compact marking device, constituted by a limited number of mechanical elements and ensuring a satisfactory quality of marking.

To these ends, the objective of the present invention is a marking device for flat sheet stock, especially of plates, comprising means for receiving a stack formed by the sheets, which sheets are moved by gravity along these receiving means in a direction of movement, a marker such as a stylus, means to position a sheet to be marked with respect to the marker, characterized by the fact that the marker is positioned below the receiving means and that it is adapted to mark the underside of the bottom sheet of the stack.

In accordance with other characteristics of the invention:

the direction of movement is tilted or inclined with respect to the vertical and the receiving means extend only over one portion of the perimeter of the stacked sheets;

the sheets are polygonal, in particular, quadrilateral, and the receiving means extend only along two adjacent sides of the stack;

the receiving means are provided with a chute, which chute is open towards its lower portion;

the chute is provided with an L-shaped traverse section and comprises two walls, tilted with respect to their perpendicular so that the sheets tend to be positioned in the angle of the L;

the positioning means of the sheet stock to be marked are provided with bearing surfaces on at last two edges opposite to the sheets;

the distance separating these bearing surfaces is adjustable;

the positioning means for the sheet to be marked includes an attached weight at the top of the stack;

the means of ejection of a marked sheet are provided with a movable element having the purpose of pushing the sheet in a direction of ejection that is perpendicular to the direction of movement, the stroke of this movable element exceeding the dimensions of the sheet with respect to this direction of ejection;

the device comprises surfaces facing each other that define a guide path for the marked sheet during its ejection phase.

The present invention also has as an objective a procedure for the marking of the flat sheet stock, such as plates, in which procedure the sheet stock material is piled up in a stack in the receiving means, the stacked sheets are moved by gravity along the receiving means, one sheet to be marked is positioned with respect to a marker such as a stylus, which sheet is marked and ejected, characterized by the fact that the underside of the bottom sheet of the stack is marked.

BRIEF DESCRIPTION OF THE DRAWINGS

The invention is described hereinafter by making reference to the accompanying drawings, given only by way of non-limiting example, and wherein.

DESCRIPTION OF THE PREFERRED EMBODIMENT

Figure 1:
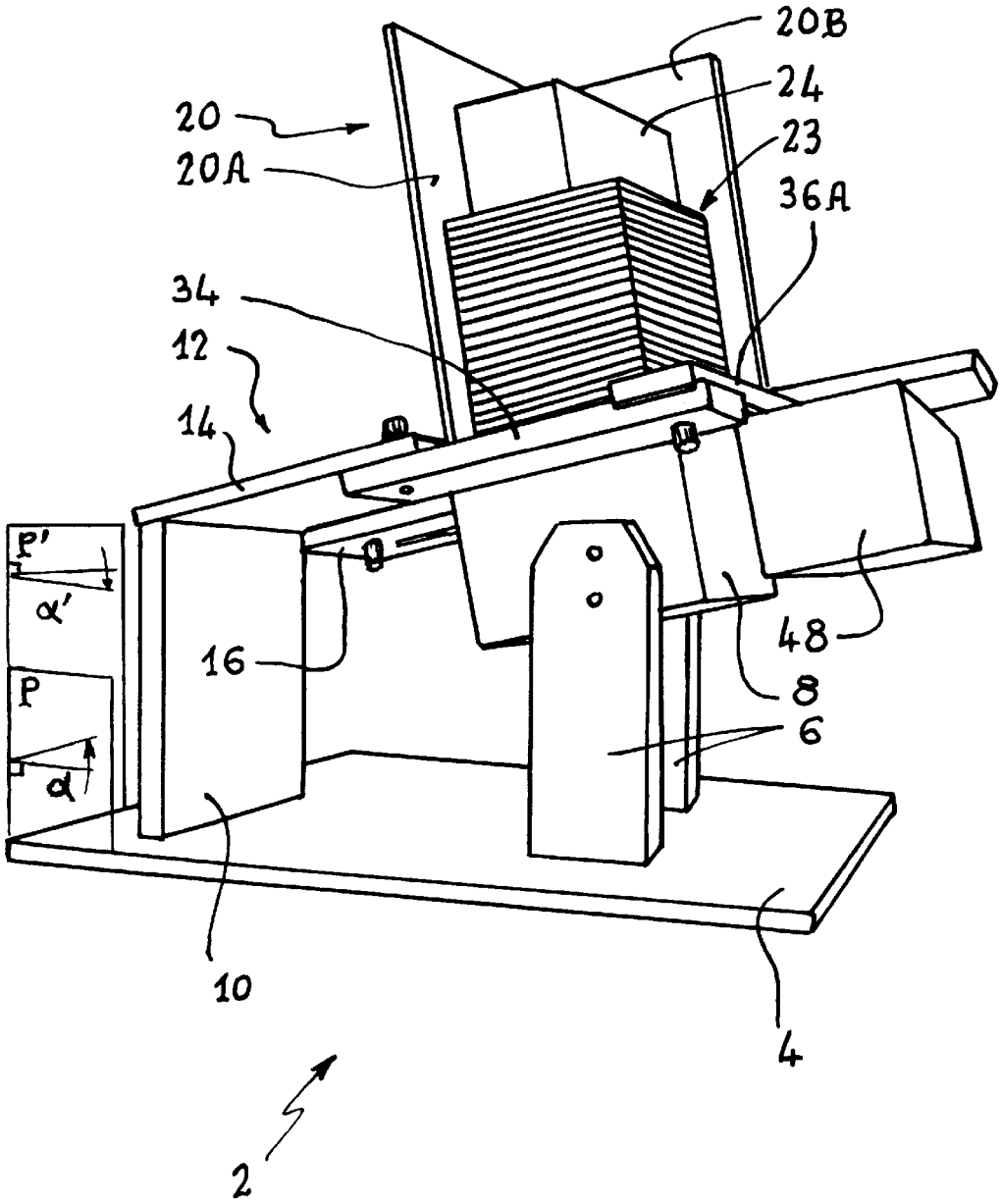
FIG. 1 shows a diagrammatic view in perspective of a marking device in accordance with the invention.

The marking device in accordance with the invention, illustrated in FIG. 1, and designated as a whole by reference number 2, comprises a base 4 provided with two supports 6 for supporting a marking unit of known type in itself, designated as a unit by reference number 8. This marking unit comprises, as it is customary, a driving mechanism, such as a cross slide, by way of example, as well as a stylus not represented in this FIG. 1 but designated by reference number 9 in FIGS. 4 and 5.

Figure 2:
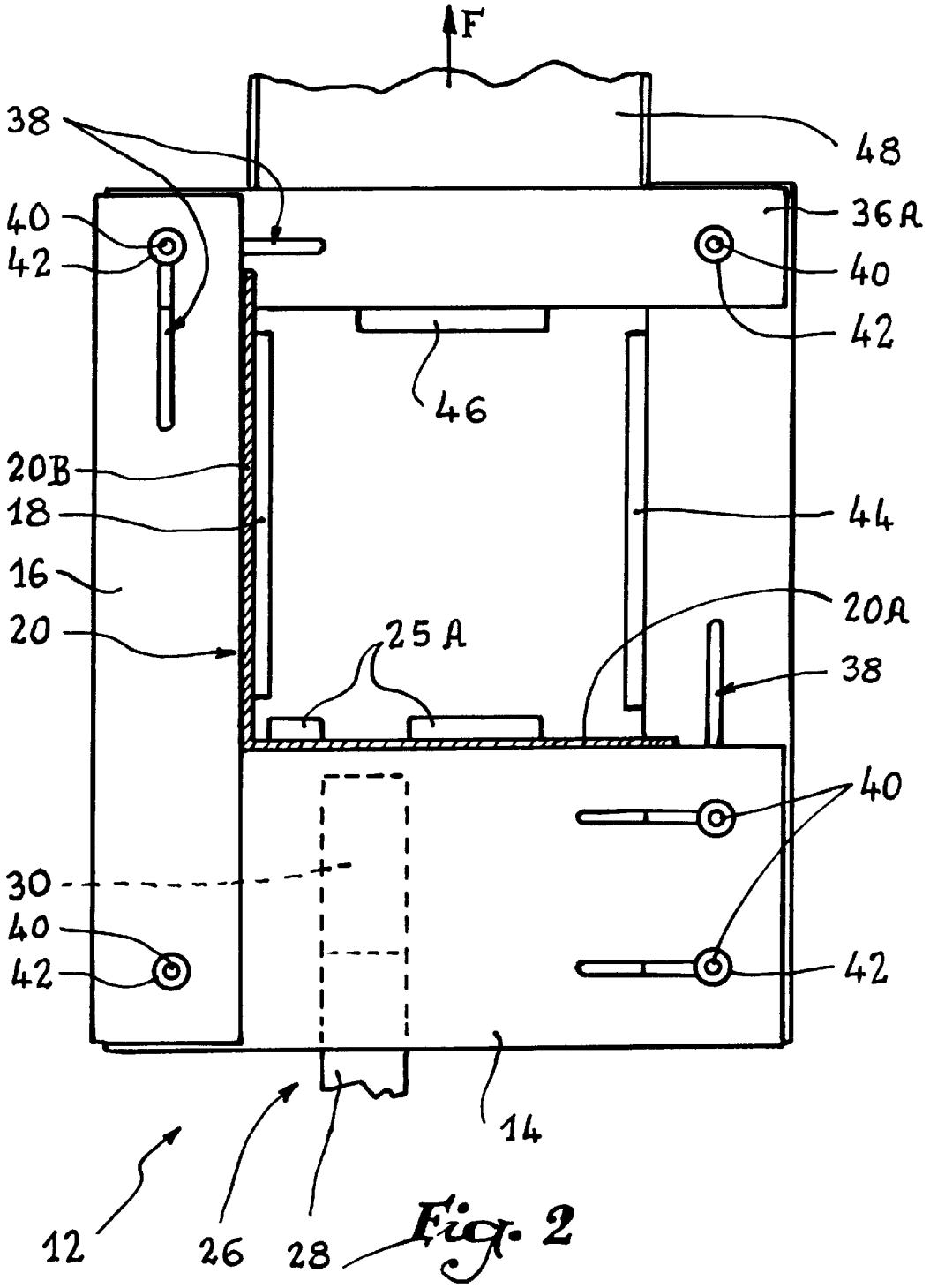
FIG. 2 shows a plan view according to the axis of the chute of a section of the marking device in accordance with the invention.

On the other hand, the device 2 comprises an essentially vertical support 10, at the upper extremity of which is attached, by any known means, a pedestal 12 which has, as it can be seen in particular in FIG. 2, an L-shape profile.

To ensure an optimum rigidity of the structural unit, in addition to the support 10, any other type of element not represented can also be provided in order to support the pedestal 12.

The pedestal 12 includes two wings perpendicular to each other and essentially co-planar. Because of reasons of convenience, herein is designated as the back wing 14, the wing arranged in the rear oriented in the direction of ejection of the marked sheets, indicated by the arrow F in FIG. 2. Thus, the other wing 16 is called left wing and is affixed, by way of example, by being screwed on to the wing 14.

Figure 3:
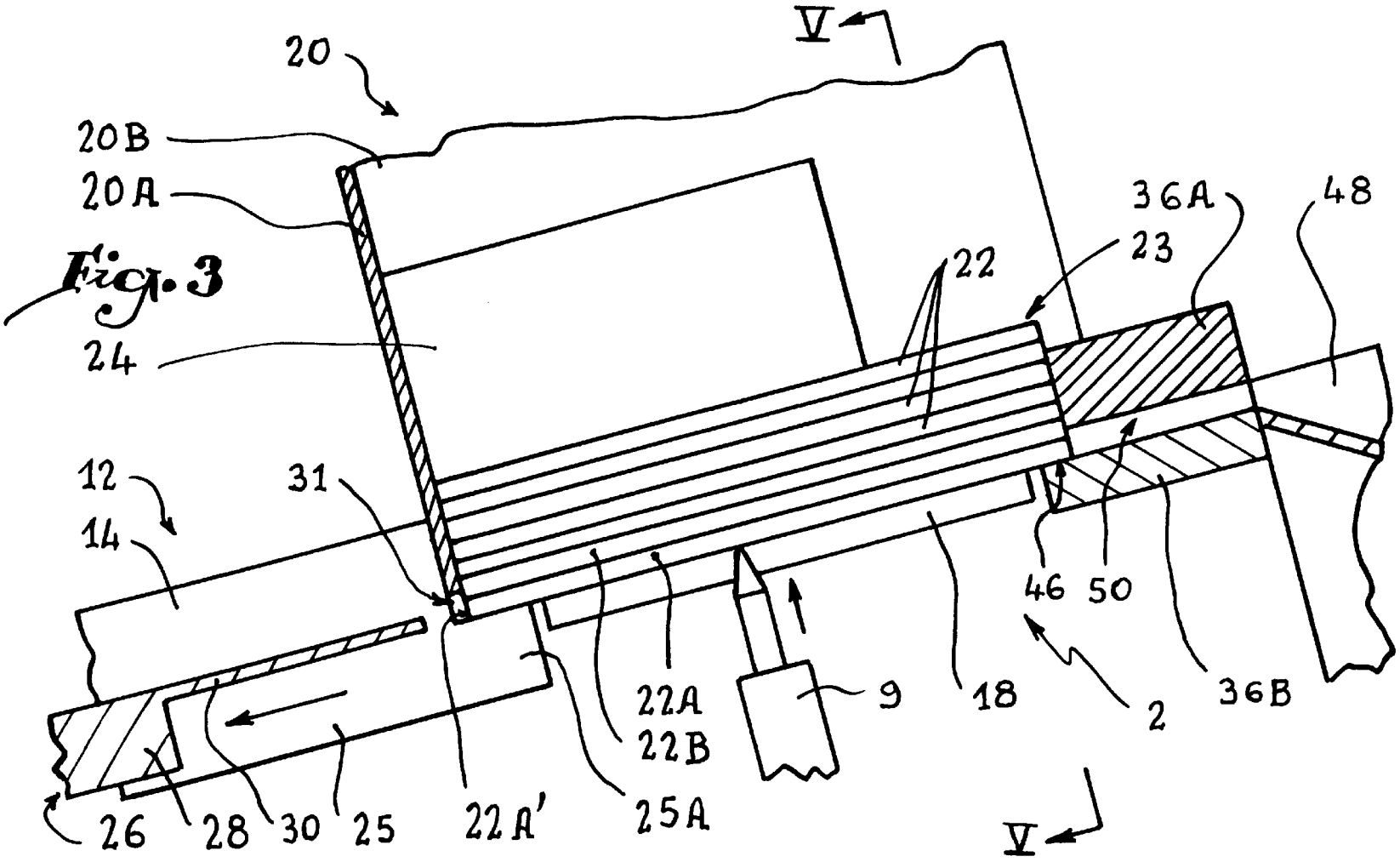
FIGS. 3 and 4 show cross sections along the line III—III of FIG. 2, representing two successive operating cycles in accordance with the invention.

As shown in FIGS. 2 and 3, the left wing 16 is provided on its inner side with a flange 18, defining a bearing surface for a sheet or plate, that will be explained below.

The pedestal 12 is tilted with respect to the horizontal on two planes perpendicular to each other. In fact, on a vertical plane P', extending parallel to the principal direction of the rear wing 14, it is tilted upwards with respect to the horizontal at an angle $\alpha$, in the direction of ejection of the marked sheets. Further, on the vertical plane P', extending parallel to the principal direction of the rear wing 14, the pedestal 12 is tilted downwards with respect to the horizontal at an angle $\alpha'$ in the direction of the left wing 16. These angles $\alpha$ and $\alpha'$ are, for example, angles of 45 to 75°.

A chute 20 of L-shaped traverse section is attached to the inner sides of the wings 14 and 16 of the pedestal 12. This chute 20 extends perpendicular to the pedestal 12, so that it is also tilted with respect to the vertical on two planes perpendicular to each other. This chute 20 constitutes a receiving means for the sheets or plates 22 that are arranged in such a manner as to form a stack 23. These plates 22 or sheets of stock, of rectangular shape, are susceptible to move by gravity along this chute 20 in direction of its longitudinal axis. A weight 24, the function of which will be explained hereinafter, is affixed above the stack 23 formed by the plates or sheet stock 22.

The chute 20 comprises two perpendicular walls, that shall be designated as rear wall 20A and left wall 20B, respectively, depending on that they are provided in the proximity of the rear wing 14 and the left wing 16, respectively, of the pedestal 12. Each of these walls 20A and 20B are thus tilted with respect to the vertical, so that the plates will have the tendency of settling in the angle of the chute 20.

Figure 4:
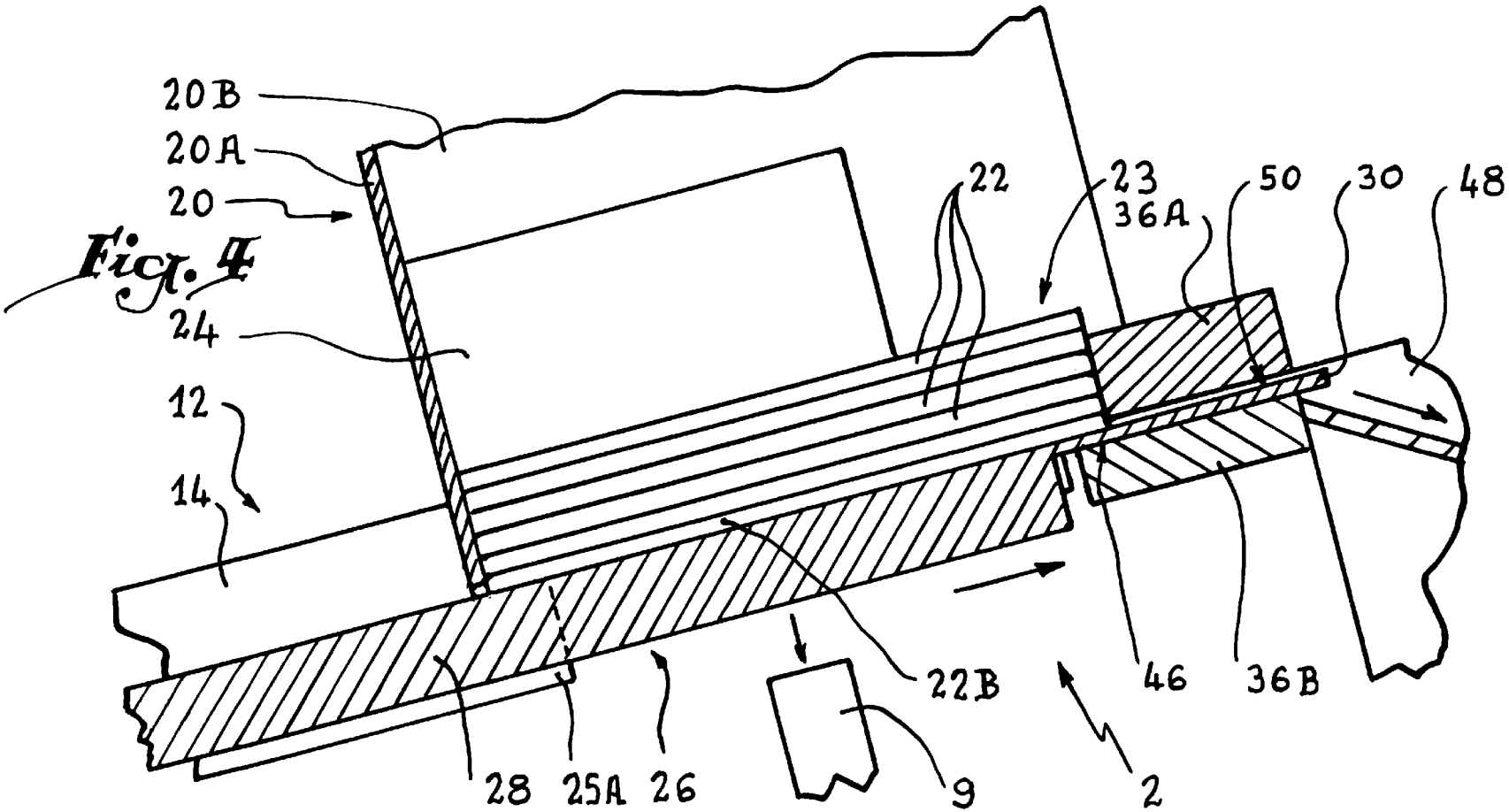
Figure 5:
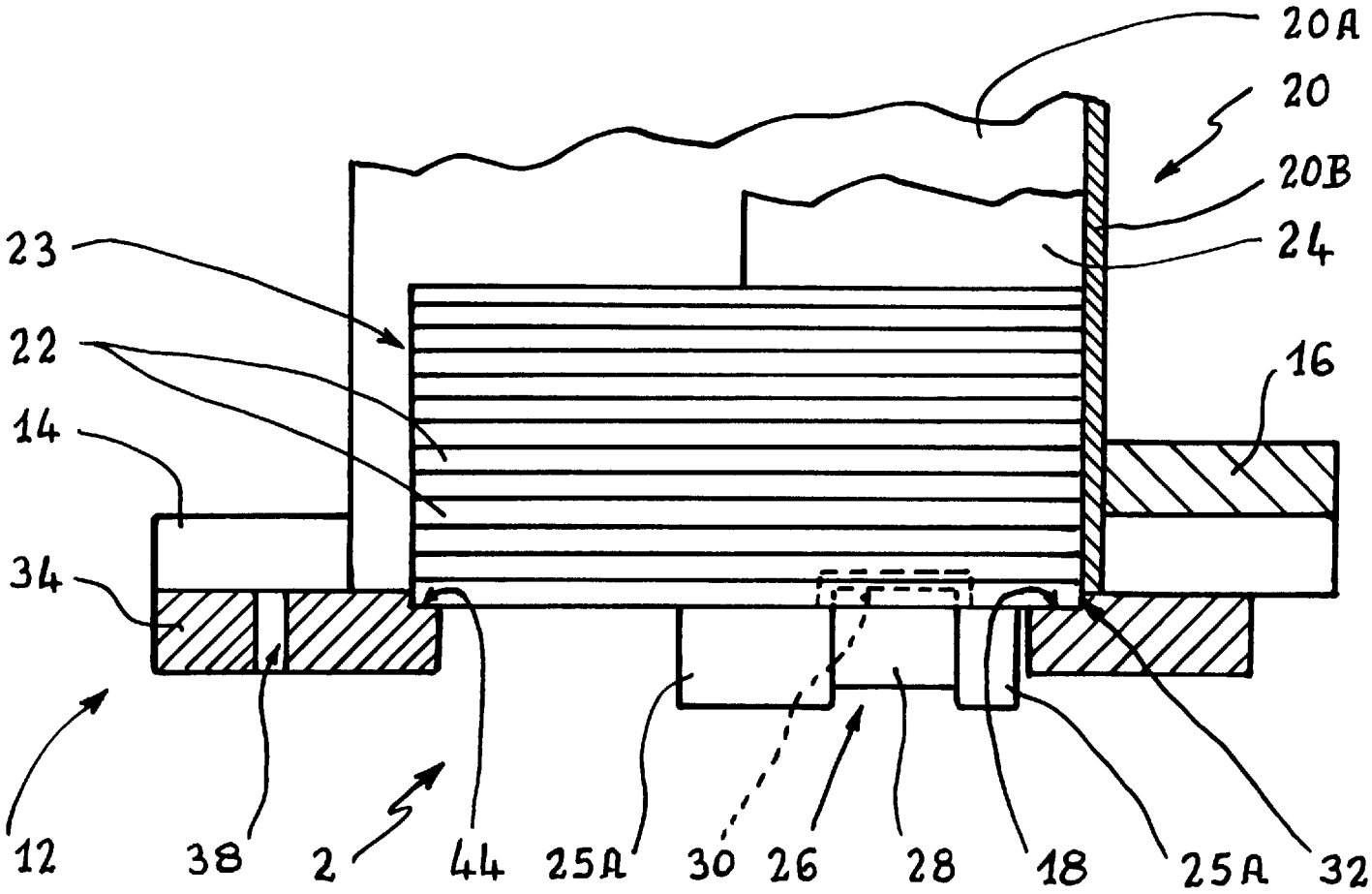
FIG. 5 shows a cross section along the line V—V of FIG. 3.

As illustrated in a more detailed manner in FIG. 4, the rear wing 14 of the pedestal 12 comprises, at a bottom projection 25, a pushing device designated as a whole by reference number 26, that is constituted by an essentially parallelpiped element 28 that ends in a tapered tongue 30. The thickness of this tongue is less than that of a plate 22. This pushing device 26 is movable in the direction of the ejection of the plates 22, indicated by arrow F, which is parallel to the longitudinal axis of the wing 16 of the pedestal 12.

As illustrated in FIG. 3, the projection 25 is provided with a flange 25A co-planar with the flange 18 of the left wing 16, and extends on both sides of the pushing device 26. The rear wall 20A of the chute 20 rests on this flange 25A and is provided with a notch 31 intended for the passage of the pushing device 26.

The left wall 20B of the chute 20 rests, as particularly illustrated in FIG. 3, at the recess 32 defining the flange 18 of the distal wing 16 of the pedestal 12. The design can be such, however, that the flange 18 constitutes a bearing surface for the chute 20.

An arm 34, parallel to the left wing 16 of the pedestal 12, is attached at the free extremity of the rear wing 14 of the pedestal 12. It is connected to two superposed crosspieces 36A, 36B, upper and lower, respectively, that are parallel to the rear wing 14 of the pedestal 12. These crosspieces, illustrated in particular in FIGS. 3 and 4, are secured at the free extremity of the left wing 16 of the pedestal 12.

The distances separating the rear wing 14 from the crosspieces 36, as well as the left wing 16 from the arm 34, respectively, are adjustable thanks to slots 38 into which enter the not represented rods, susceptible to be moved by means of knurled knobs 42. The arm 34 is provided with a flange 44, illustrated in FIGS. 2 and 5, and fastened opposite the flange 18 on which is provided the left wing 16; these two flanges are positioned on a same plane parallel to the plane of the pedestal.

The distance separating the two crosspieces 36A, 36B is adjustable by not represented known means. With respect to the upper crosspiece 36A, the lower crosspiece 36B projects towards the rear wing 14A of the pedestal 12 so that it constitutes a flange 46 arranged on the same plane as the previously described flanges 18 and 44. Also affixed is a receptacle 48 to the lower crosspiece 36B at its side facing the pedestal 12.

As illustrated in FIGS. 2 and 3, the bottom sheet or plate 22A of the stack 23 rests with its four edges on the pertinent co-planar flanges 18, 25A, 44, and 46 that are mounted on the left wing 16, the projection 25, the arm 34, and the lower crosspiece 36B, respectively. Further, this plate 22A is kept transversely by means of the lower extremity of the rear wall 20A of the chute 20. Lastly, when the stylus or other marking device 9 enters into action on the underside of the plate 22A, illustrated in FIG. 3A, the upper sheets or plates as well as the weight 24 ensure the firm holding of the bottom plate 22A when exposed to the action of the marker.

The plate 22B arranged directly above plate 22A is kept transversely by the lower extremity of the chute and the crosspiece 36A.

FIGS. 3 and 4 illustrate the ejection phase of the bottom plate 22A. This ejection is accomplished by the pushing device 26. The tapered tongue 30 of the latter enters into the notch 31 of the rear wall 20A, enters into contact with the edge of the plate 22A and conveys it between the sides opposite the crosspieces 36A, 36B which delimit in this manner a guide path 50. The distance separating these two crosspieces 36A, 36B is preferably comprised between one and one and half times the thickness of each plate 22. The stroke of the pushing device 26 in the direction of ejection of the sheets or plates 22 is greater than the dimensions of the plates 22. Moreover, the dimensions of the tongue 30, in the direction of ejection of the plates 22, are greater than those of the crosspieces 36A, 36B. In this manner, at the end of the stroke of the pushing device, the tongue 30 of this device penetrates into the guide path 50 and ejects the bottom plate 22A, which is in the receptacle 48.

Afterwards, by means of a not represented actuating element the pushing device 26 is actuated in such a manner that it returns to its retracted position, illustrated in FIG. 4. The plate 22B, in place directly above the bottom plate 22A, takes the place of the latter and, in turn, is supported by the flanges 18, 25A, 44, and 46. A new marking operation by means of the stylus or marking element 9 can thus be effectuated on this plate 22B which, after having been marked, will be ejected in a manner analogous to the above described operation.

As the marking operations proceed, each of the plates or sheet stock 22, forming the stack 23, moves along the chute 20 by gravity, it is marked by the marker 9 and it is then ejected by the pushing device 26. When the number of plates or sheets 22 constituting the stack 23 is reduced, the weight 24 is particularly advantageous inasmuch as during the marking operation, it keeps the bottom plate in place against the marker 9.

The device in accordance with the present invention is shown in all the illustrations with a feed chute tilted with respect to the vertical. Naturally, the design can be such that this chute would present an essentially vertical longitudinal axis. In such a case, its walls encircle the entire perimeter of the plates that can be accommodated.

Moreover, it is also possible to use sheet stock that is not rectangular but rather round or oval.

The invention allows the attaining of the above-mentioned objectives. In fact, the marking of the underside of the bottom plate 22A of the stack 23 allows the dispensing with a conveyor unit for the bottom plate in direction to the marker, as it was the case in previously known types. The holding firm of this bottom plate to be marked is effectuated by mechanical elements of very simple configuration, so that for the upper plates it is only necessary to add a weight on top of the stack of plates, if need be.

The fact of providing a receiving chute tilted with respect to the vertical does also offer specific advantages. In fact, this chute is of a particularly simple construction, since it is constituted by nothing else than two L-shaped sections. Thus, the loading of the plates is considerably simplified with respect to a chute encircling the entire perimeter of the plates.

Moreover, the visibility of the marking area by the operator is very good during the marking cycle, which is extremely beneficial. Lastly, a tilted chute is susceptible to be fit for all types of plates since it extends only over a portion of their periphery. The presence of means that enable an adjustment of the distance separating the proximal wing of the pedestal from the crosspieces as well as the distal wing of the pedestal from the arm, respectively, allows to effectuate the holding of plates or sheet stock of different sizes.

What is claimed is:

1. A marking device for sheets of stock material comprising, receiving means for retaining a stack of the sheets of stock material such that all of the sheets of the stack are retained flat and move by gravity along said receiving means in a direction of movement, a marker, means for positioning a bottom sheet of said stack of sheets of stock material to be marked by said marker so that the bottom sheet is flat and held by remaining sheets of the stack of sheets of stock material when being marked, ejection means for ejecting the marked sheets of stock material so that the marked sheets remain flat, and said marker being arranged under the receiving means and adapted to mark an underside of the bottom sheet of said stack of sheets of stock material.

2. A device in accordance with claim 1 wherein the direction of movement is inclined with respect to the vertical and said receiving means extends only over a section of a perimeter of the stack of sheets of stock material.

3. A device in accordance with claim 2 wherein the sheets of stock material are polygonal, and that the receiving means extends only along two adjacent sides of the stack.

4. A device in accordance with claim 1 wherein the receiving means includes a downwardly open chute.

5. A device in accordance with claim 4 wherein the chute has an L-shaped traverse section including two walls that are angled with respect to the vertical so that the sheets settle in an angle of the L-shaped section of the chute.

6. A marking device for sheets of stock material comprising, receiving means for retaining a stack of the sheets of stock material which sheets move by gravity along said receiving means in a direction of movement, a marker, means for positioning a sheet of stock material to be marked by said marker, ejection means for the marked sheets of stock material, said marker being arranged under the receiving means and adapted to mark an underside of a bottom sheet of stock material of the stack, and wherein said means for positioning the sheets to be marked includes bearing surfaces on at least two edges opposite to said sheets.

7. A device in accordance with claim 6 including means for adjusting a distance separating the bearing surfaces.

8. A device in accordance with claim 6 wherein the means for positioning the sheets to be marked includes a weight placed on a top sheet of the stack.

9. A marking device for sheets of stock material comprising, receiving means for retaining a stack of the sheets of stock material which sheets move by gravity along said receiving means in a direction of movement, a marker, means for positioning a sheet of stock material to be marked bv said marker, ejection means for the marked sheets of stock material, said marker being arranged under the receiving means and adapted to mark an underside of a bottom sheet of stock material of the stack, and wherein said ejection means for the marked sheets is provided with a movable element to push said sheets in an ejection direction perpendicular to the direction of movement, said movable element having a stroke greater than the dimension of a sheet in the ejection direction.

10. A device in accordance with claim 9 including opposite surfaces defining a guide path for the marked sheets during ejection.

11. A procedure for the marking of sheets of stock material, in which procedure the sheets are piled up in a stack in a receiving means such that the sheets are retained flat, the stacked sheets are moved by gravity along said receiving means, a bottom sheet to be marked is positioned with respect to a marker, and the bottom sheet is marked so that the underside of the bottom sheet of the stack is marked while being held flat by remaining sheets of the stack and thereafter ejecting the bottom sheet from the stack.

* * * * *